US010625535B2

(12) United States Patent
Furick

(10) Patent No.: US 10,625,535 B2
(45) Date of Patent: Apr. 21, 2020

(54) RINGED BINDER

(71) Applicant: Michael Furick, Mooresville, NC (US)

(72) Inventor: Michael Furick, Mooresville, NC (US)

( * ) Notice: Subject to any disclaimer, the term of this patent is extended or adjusted under 35 U.S.C. 154(b) by 0 days.

(21) Appl. No.: 16/395,975

(22) Filed: Apr. 26, 2019

(65) Prior Publication Data

US 2019/0329584 A1 Oct. 31, 2019

Related U.S. Application Data

(60) Provisional application No. 62/663,620, filed on Apr. 27, 2018.

(51) Int. Cl.

| | |
|---|---|
| ***B42F 13/00*** | (2006.01) |
| ***B42F 13/16*** | (2006.01) |
| ***B42F 13/40*** | (2006.01) |

(52) U.S. Cl.

CPC ..... *B42F 13/16* (2013.01); *B42F 13/002* (2013.01); *B42F 13/0006* (2013.01); *B42F 13/408* (2013.01)

(58) Field of Classification Search

CPC ... B42F 13/408; B42F 13/0006; B42F 13/002

USPC ..... 402/80 L, 73–78

See application file for complete search history.

(56) References Cited

U.S. PATENT DOCUMENTS

| | | | | |
|---|---|---|---|---|
| 2,440,939 A * | 5/1948 | Franz, Jr. | ..... | B42F 13/408 402/80 L |
| 4,573,822 A * | 3/1986 | Allen | ..... | B42F 13/408 402/80 L |
| 5,118,213 A * | 6/1992 | Meservy | ..... | B42F 13/408 402/80 R |

FOREIGN PATENT DOCUMENTS

| | | | | |
|---|---|---|---|---|
| CH | 395022 A * | 7/1965 | ..... | B42F 13/408 |
| GB | 190915890 A * | 7/1910 | ..... | B42F 13/408 |

* cited by examiner

*Primary Examiner* — Kyle R Grabowski

(74) *Attorney, Agent, or Firm* — Brandon Trego; Jonathan Hines

(57) ABSTRACT

A ringed binder with moveable platforms is disclosed. The ringed binder including a center support section; a first platform connected to the center support section and configured to move between a lowered position and a raised position; and a second platform connected to the center support section and configured to move between a lowered position and a raised position.

14 Claims, 8 Drawing Sheets

RINGED BINDER

BACKGROUND OF THE INVENTION

This invention relates generally to a ringed binder such as a three ring binder, and more particularly to a ringed binder with moveable platforms.

Ringed binders are well-known; have been used by businesses, schools, students, and individuals who simply want to keep material organized for many years; and come in many different sizes. Ringed binders typically include an outer cover, a base extending along an inner middle portion of the outer cover, and three individual rings protruding outwardly from the base. The three rings are moveable between an open position to allow media with holes to be received by the rings and a closed position to secure the media to the rings in the binder.

Often, ringed binders are used to simply store or compile material therein; however, many individuals, such as students, place media, such as blank pages of paper, in the ringed binder and use it as a notebook.

Unfortunately, the rings protruding can make using the ringed binder as a notebook difficult. As shown in FIG. 1, the rings protrude beyond the media secured thereto and can interfere with a user's hand when trying to write on the media. For example, a left handed user would have a difficult time navigating the rings when writing on media positioned to the right of the rings and a right handed person would have a difficult time navigating the rings when writing on media positioned to the left of the rings.

Accordingly, there is a need for a ringed binder that minimizes interference by the rings.

BRIEF SUMMARY OF THE INVENTION

This need is addressed by the present invention, which provides a ringed binder with moveable platforms to raise media above the rings of a ringed binder.

According to an aspect of the invention, a ringed binder includes a center support section; a first platform connected to the center support section and configured to move between a lowered position and a raised position; and a second platform connected to the center support section and configured to move between a lowered position and a raised position.

According to another aspect of the invention, a ringed binder includes an outer cover having a first cover section, a second cover section, and a center support section interconnecting the first and second cover sections; a first platform connected to the first cover section and configured to move between a lowered position and a raised position; and a second platform connected to the second cover section and configured to move between a lowered position and a raised position.

According to another aspect of the invention, a ringed binder includes a center support section having a first platform support, a second platform support, and a center support interconnecting the first and second platform supports; a first platform connected to the first platform support and configured to move between a lowered position and a raised position; and a second platform connected to the second platform support and configured to move between a lowered position and a raised position

BRIEF DESCRIPTION OF THE DRAWINGS

The invention may be best understood by reference to the following description taken in conjunction with the accompanying drawing figures, in which.

DETAILED DESCRIPTION OF THE INVENTION

Figure 1:
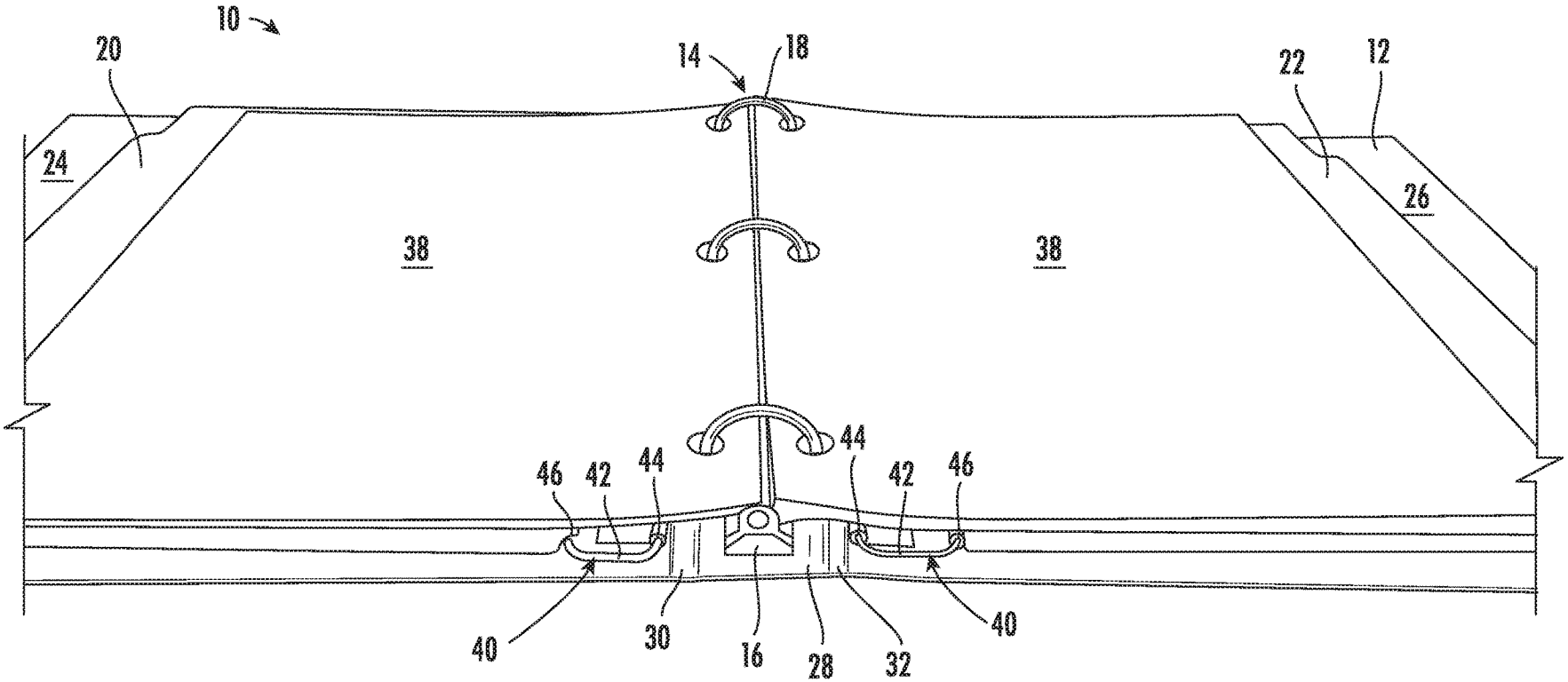
FIG. 1 shows a ringed binder according to an embodiment of the invention.
Figure 2:
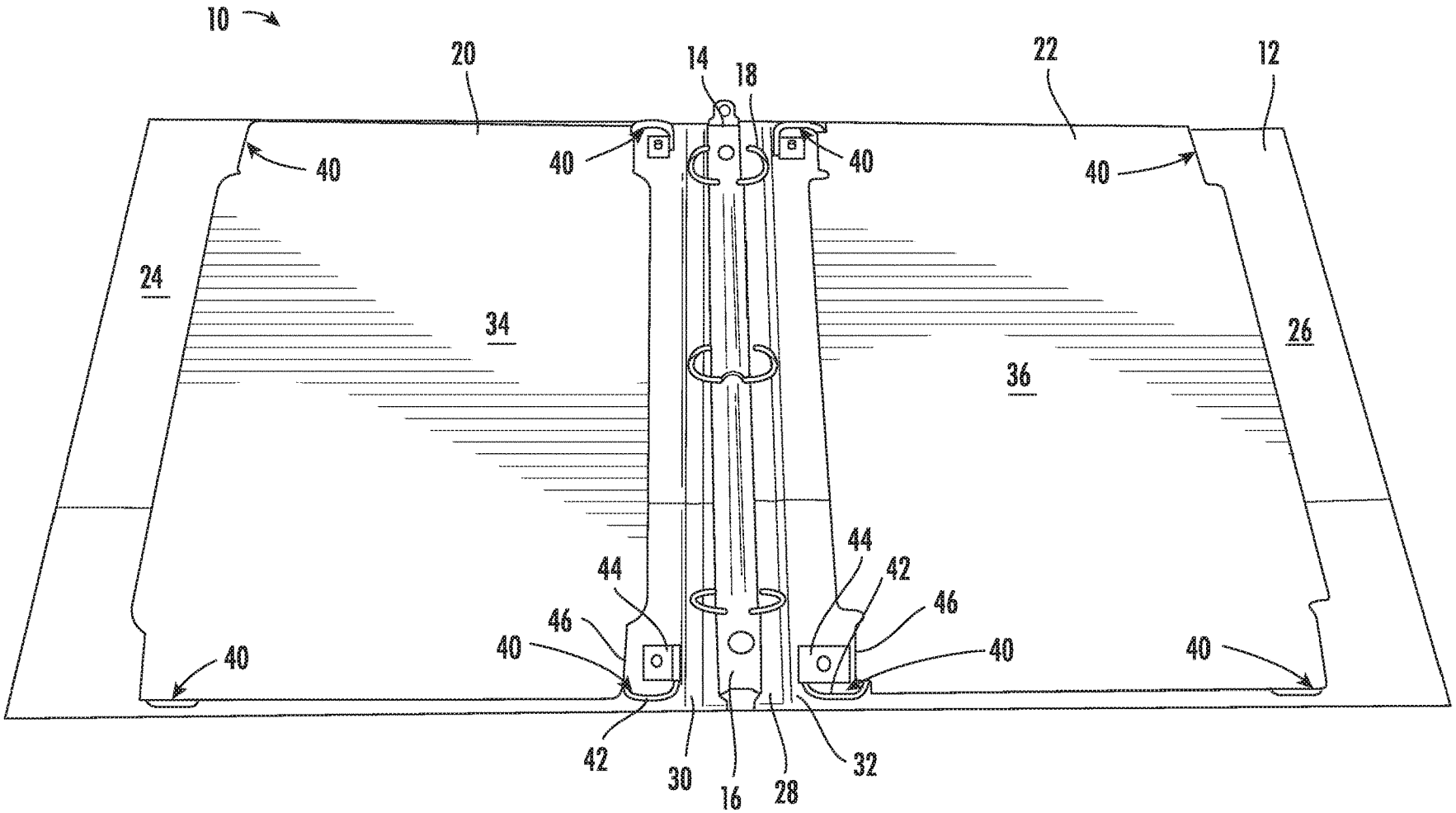
FIG. 2 shows two platforms used in the ringed binder of FIG. 1 in a lowered position.

Referring to the drawings wherein identical reference numerals denote the same elements throughout the various views, FIG. 1 illustrates an exemplary ringed binder 10. The ringed binder 10 includes an outer cover 12, a ring assembly 14 having a base 16 and a plurality of rings 18, and first and second platforms 20 and 22 secured to the outer cover 12. As illustrated, the ring assembly 14 includes three rings 18; however, it should be appreciated that any suitable number of rings may be used.

The outer cover 12 includes a left cover section 24, a right cover section 26, and a center support section 28 interconnecting the left and right cover sections 24, 26. As shown, the left cover section 24 is hingedly connected to the center support section 28 by hinge 30 and the right cover section 26 is hingedly connected to the center support section 28 by hinge 32. For purposes of this application, a hinge is defined as any mechanism that allows pivotal or bending movement. The ring assembly 14 extends a length of the center support section 28 and is secured thereto. The hinges 30, 32 allow the ringed binder 10 to move between an open position, FIG. 1, and a closed position.

Referring to FIGS. 2-5, the first platform 20 is secured to the left cover section 24 and the second platform 22 is secured to the right cover section 26. The platforms 20 and 22 are made of a light, rigid material and include writing surfaces 34 and 36 suitable to support media 38, FIGS. 6 and 7, and allow a user to write on the media 38. Examples of suitable materials include thin sheets of metals and/or plastics. The writing surfaces 34, 36 are smooth and free of defects (such as ridges, undulations, etc.) to allow a user to write on the media 38 without interference from the defects.

Figure 3:
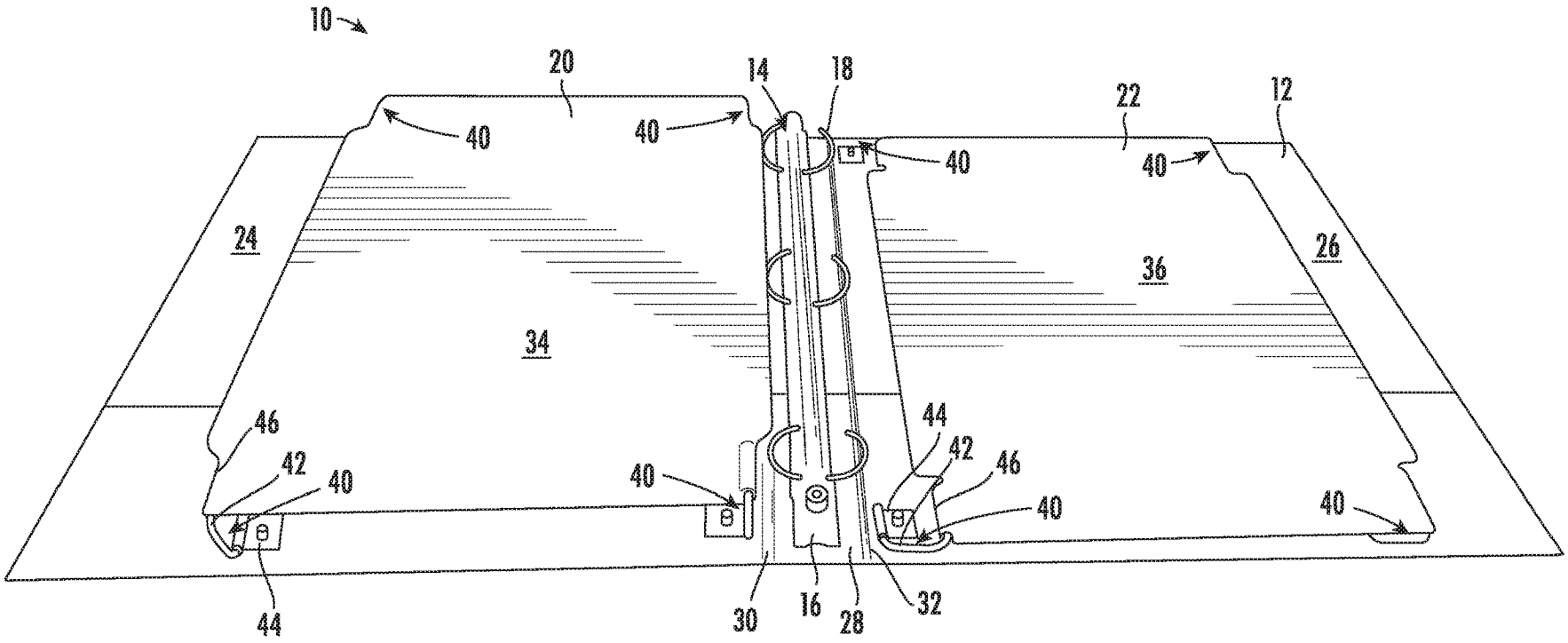
FIG. 3 shows one of the platforms of FIG. 2 in a raised position.
Figure 4:
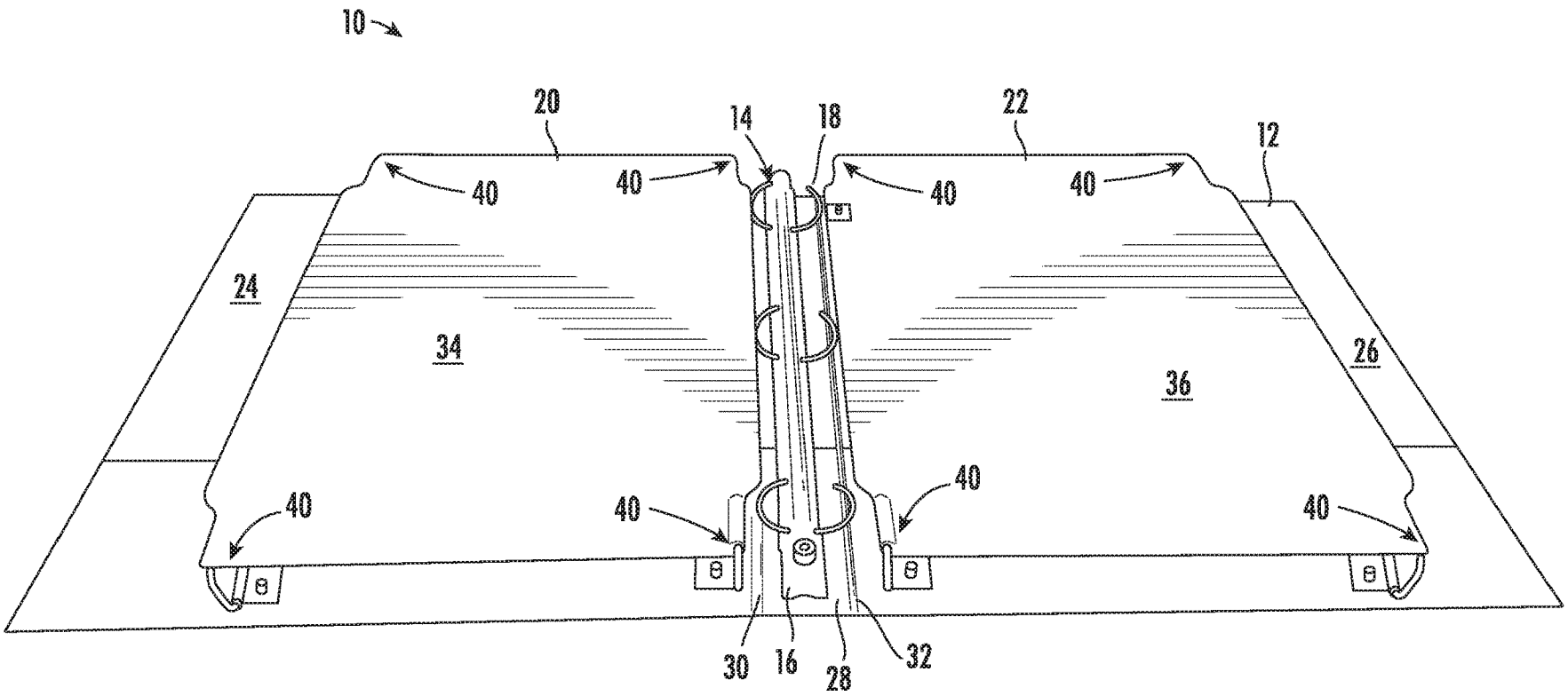
FIG. 4 shows both of the platforms of FIG. 2 in a raised position.
Figure 5:
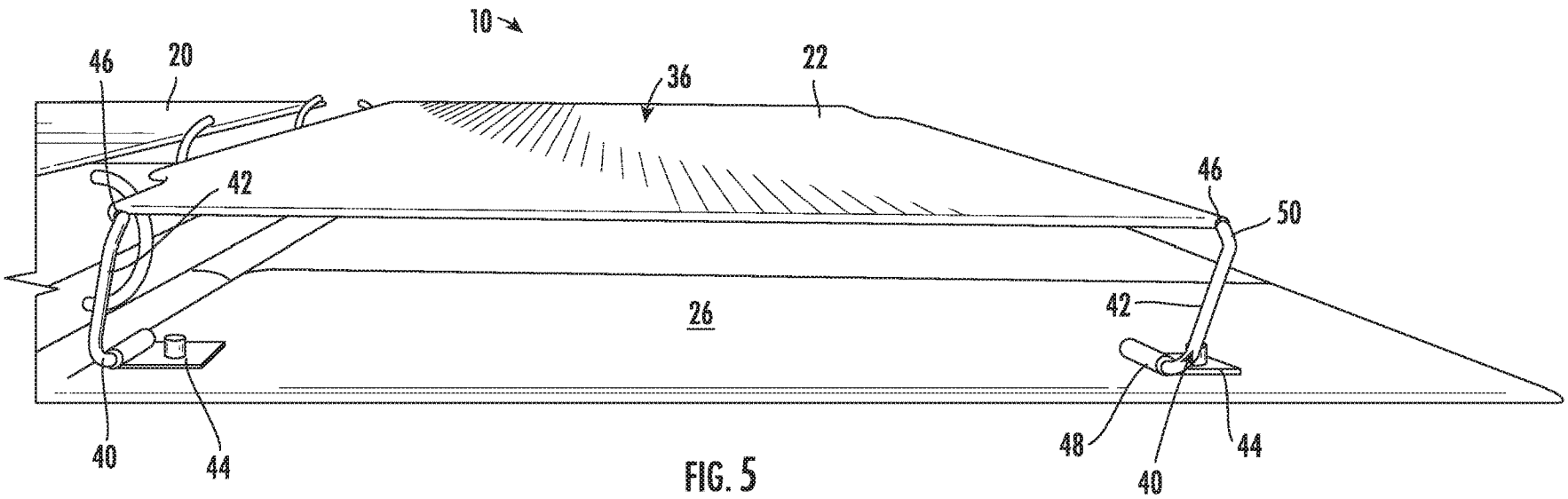
FIG. 5 is a side view of the ringed binder of FIG. 1 with a platform of FIG. 2 in a raised position.

As illustrated, the first and second platforms 20, 22 are secured to the outer cover 12 by hinges 40. The hinges 40 are located at each corner of the first and second platforms 20, 22 to allow each of the platforms 20, 22 to be raised and lowered. As shown, the platforms 20, 22 are capable of moving independently of each other (FIGS. 3 and 4). Each of the hinges 40 include a C-shaped connector 42, a first receiver 44 connected to the outer cover 12, and a second receiver 46 connected to or integrally formed with the respective platform 20, 22. As shown, a first end 48 of the connector 42 is received in the first receiver 44 for pivotal movement and a second end 50 is received in the second receiver 46 for pivotal movement.

It should be appreciated that other types of mechanisms may be used to raise and lower the platforms 20, 22. For example, a central hinge may be connected between the outer cover 12 and a bottom of a respective one of the platforms 20, 22; or an accordion or popup type of connection may be used; or any other suitable mechanism that permits the platforms to be raised and lowered.

Alternatively, a hinge, stand, or other type of mechanism may also be used with or integrated with the outer cover 12 to allow one or both of the left and right cover sections 24, 26 to be raised to allow a user to write on media 38 without interference from rings 18. For example, a kick stand may be integrated with the left cover section 24 so that when the kickstand is moved from a storage position to a use position, the left cover section 24 is held in a raised position. Likewise, the outer cover 12 may include double hinges to allow both cover sections 24, 26 to be raised at the same time.

Figure 6:
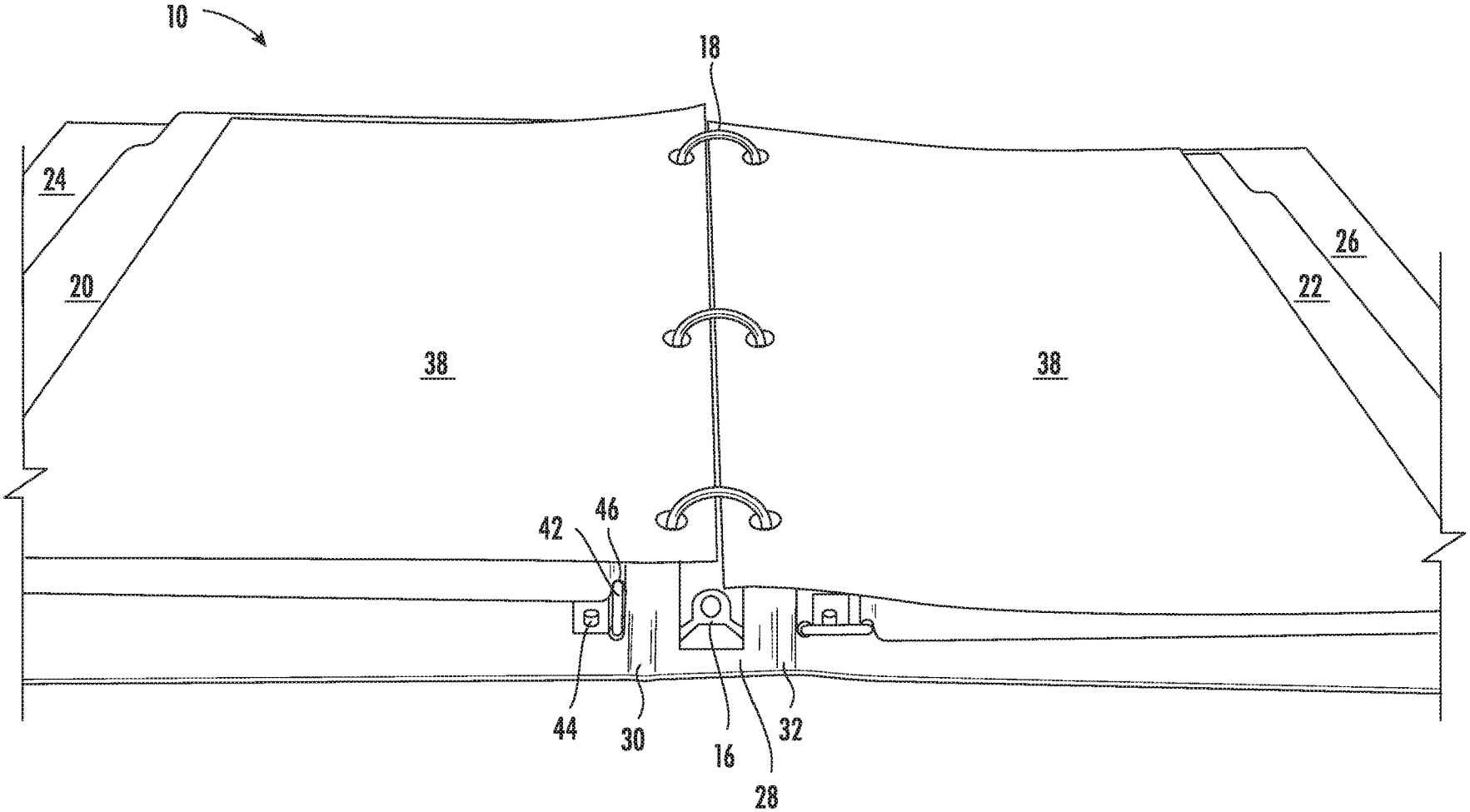
FIG. 6 shows one of the platforms of FIG. 2 raising media above rings of the ringed binder.
Figure 7:
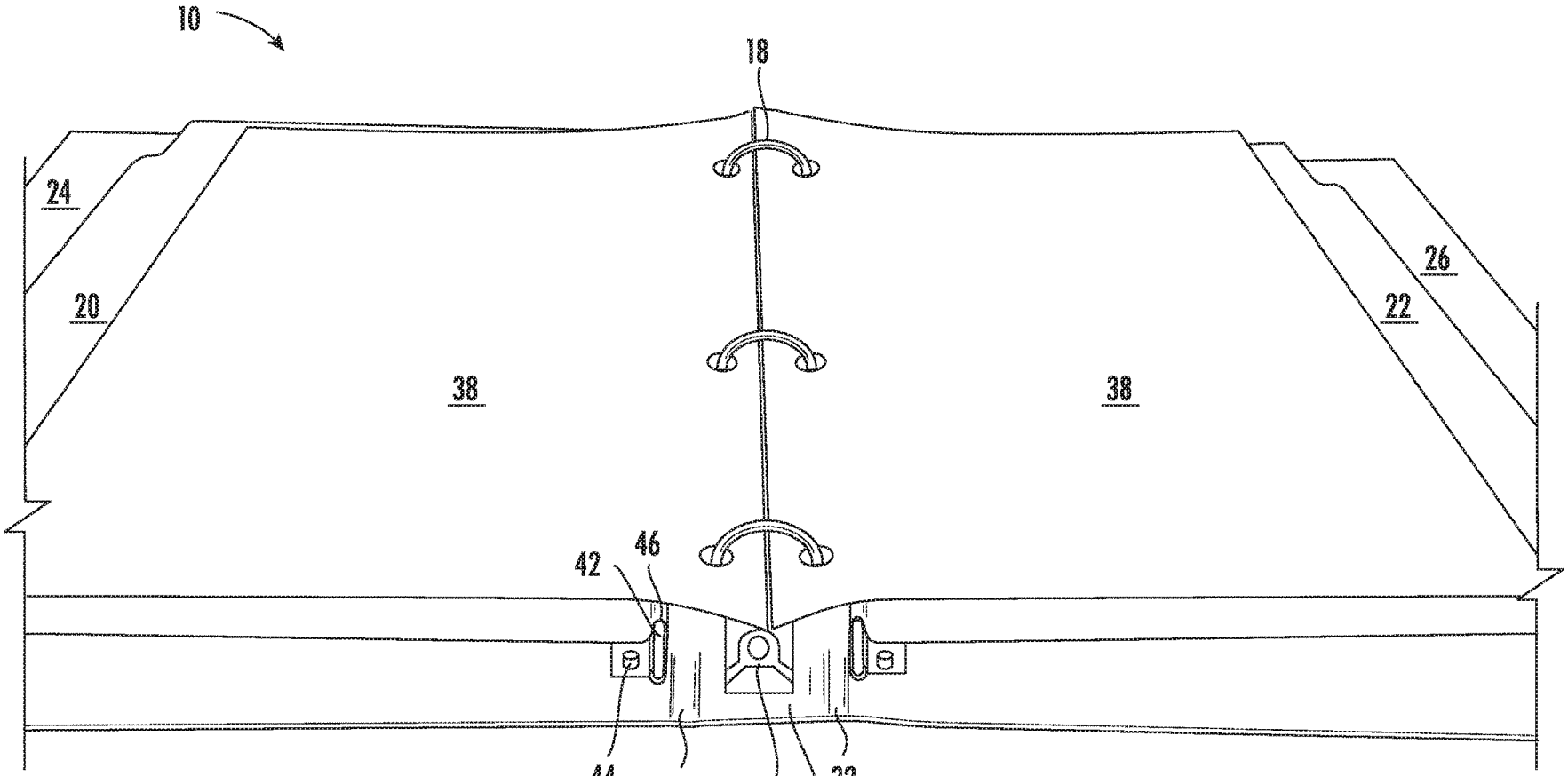
FIG. 7 shows both of the platforms of FIG. 2 raising media above the rings of the ringed binder.

Referring to FIGS. 6 and 7, the platforms 20, 22 allow a user to adjust a height of the media 38 with respect to rings 18. As illustrated in FIG. 6, platform 20 is raised to position media 38 at a height substantially equal to a height of rings 18. FIG. 7 shows platforms 20 and 22 both raised to position media 38 at a height substantially equal to a height of rings 18. In other words, the rings do not protrude significantly above a plane of the media 38; thus, allowing a user to write on the media 38 without interference from the rings 18.

Figure 8:
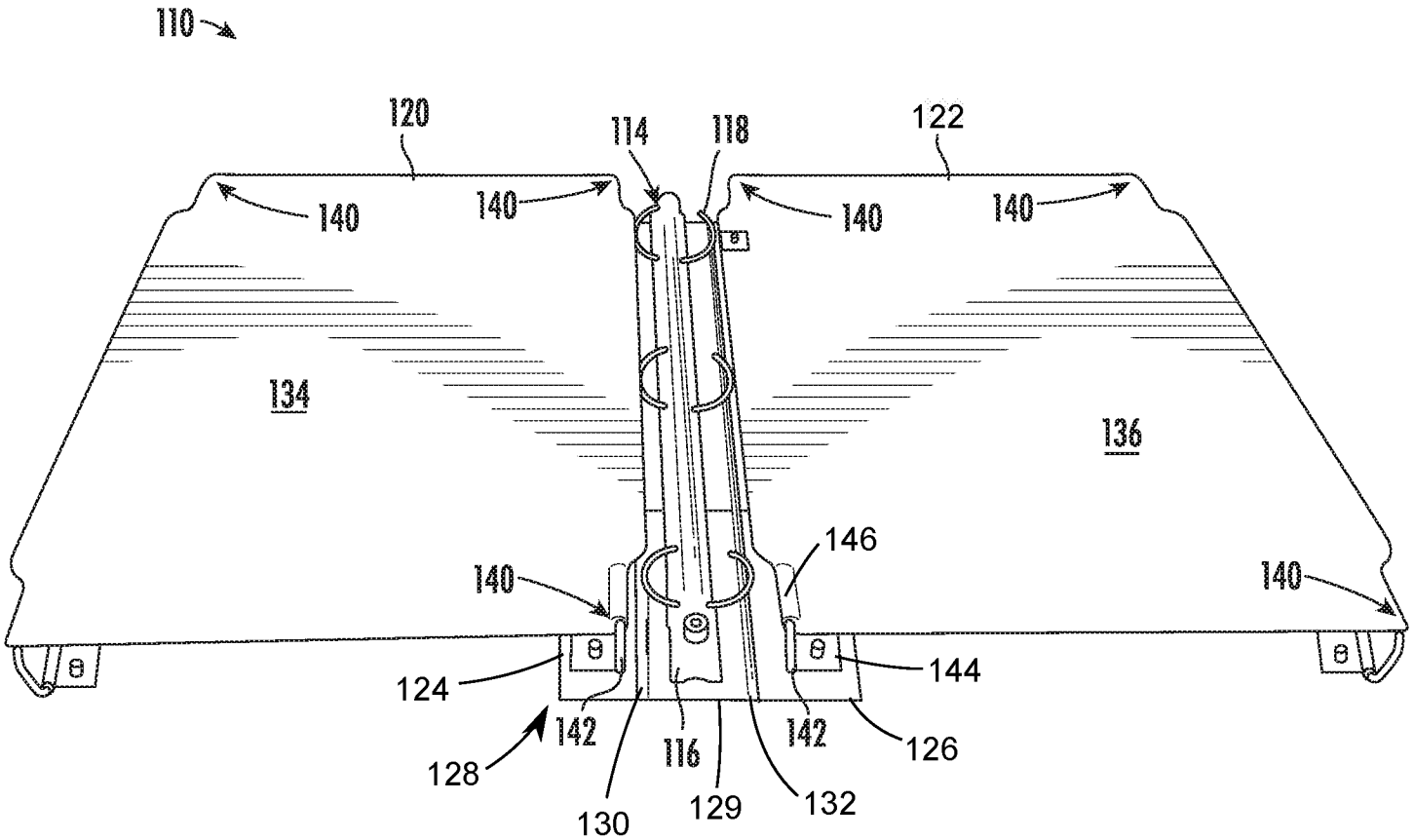
FIG. 8 shows a ringed binder according to an embodiment of the invention.

An exemplary ringed binder 110 is illustrated in FIG. 8. Like ringed binder 10, ringed binder 100 includes a ring assembly 114 having a base 116 and a plurality of rings 118, and first and second platforms 120 and 122. The ring assembly 114 is supported by and/or connected to a center support section 128 which interconnects the first and second platforms 120 and 122. As shown, the center support section 128 includes a first platform support 124, a center support 129, and a second platform support 126. As illustrated, the first platform support 124 is hingedly connected to the center support 129 by hinge 130 and the second platform support 126 is hingedly connected to the center support 129 by hinge 132.

The ring assembly 114 is supported by and/or connected to the center support 129, the first platform 120 is connected to the first platform support 124, and the second platform 122 is connected to the second platform support 126. As shown, the first and second platforms 120 and 122 are connected to the first and second platform supports 124, 126, respectively, by hinges 140. The hinges 140 are located at each corner of the first and second platforms 120, 122 to allow each of the platforms 120, 122 to be raised and lowered. In the current example, only two of the hinges 140 for each platform (inner hinges 140) are connected to the first and second platform supports 124, 126. The outer hinges 140 are not connected to the center support section 128 and pivot to an upright position to provide a support in the raised position and pivot to a horizontal position to lower the platforms 120, 122. Like hinges 40 above, hinges 140 pivot to raise and lower the platforms 120, 122 and include a connector 142, a first receiver 144 connected to the first and second platform supports 124 and 126, and a second receiver 146 connected to or integrally formed with the respective platform 120, 122.

Unlike ringed binder 10, ringed binder 110 does not include left and right cover sections. Instead, the first and second platforms 120, 122 function as both a writing surface 134 and 136 and left and right covers (i.e., they function like left and right cover sections 24 and 26).

The foregoing has described a ringed binder. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying claims, abstract and drawings), or to any novel one, or any novel combination, of the steps of any method or process so disclosed.

I claim:

1. A ringed binder, comprising:

a center support section;

a ring assembly secured to the center support section;

a first platform connected to the center support section and configured to move between a lowered position and a raised position, the first platform including a first hinge positioned at a first corner of the first platform, a second hinge positioned at a second corner of the first platform, a third hinge positioned at a third corner of the first platform, and a fourth hinge positioned at a fourth corner of the first platform, the first, second, third, and fourth hinges configured to move the first platform between the lowered and raised positions; and a second platform connected to the center support section and configured to move between a lowered position and a raised position, the second platform including a fifth hinge positioned at a first corner of the second platform, a sixth hinge positioned at a second corner of the second platform, a seventh hinge positioned at a third corner of the second platform, and an eighth hinge positioned at a fourth corner of the second platform, the fifth, sixth, seventh, and eighth hinges configured to move the second platform between the lowered and raised positions.

2. The ringed binder according to claim 1, further including a first cover section hingedly connected to the center support section.

3. The ringed binder according to claim 1, further including a second cover section hingedly connected to the center support section.

4. The ringed binder according to claim 1, wherein the first, second, third, fourth, fifth, sixth, seventh, and eighth hinges each include a first receiver, a second receiver, and a connector interconnecting the first and second receivers, a first end of the connector being pivotally received by the first receiver and a second end of the connector being pivotally received by the second receiver.

5. A ringed binder, comprising:

an outer cover having a first cover section, a second cover section, and a center support section interconnecting the first and second cover sections;

a ring assembly secured to the center support section;

a first platform connected to the first cover section and configured to move between a lowered position and a raised position, wherein the first platform is connected to the first cover section by at least one hinge positioned at each of a first corner, a second corner, a third corner, and a fourth corner of the first platform, the at least one hinge including a first receiver, a second receiver, and a connector interconnecting the first and second receivers, a first end of the connector being pivotally received by the first receiver and a second end of the connector being pivotally received by the second receiver to permit the first platform to move between the lowered and raised positions; and a second platform connected to the second cover section and configured to move between a lowered position and a raised position.

6. The ringed binder according to claim 5, wherein the first platform is hingedly connected to the first cover section and the second platform is hingedly connected to the second cover section.

7. The ringed binder according to claim 5, wherein the first cover section is hingedly connected to the center support section.

8. The ringed binder according to claim 5, wherein the second cover section is hingedly connected to the center support section.

9. The ringed binder according to claim 5, wherein the first receiver is connected to the first cover section and the second receiver is connected to the first platform.

10. The ringed binder according to claim 5, wherein the second platform is connected to the second cover section by at least one hinge, the at least one hinge including a first receiver, a second receiver, and a connector interconnecting the first and second receivers, a first end of the connector being pivotally received by the first receiver and a second end of the connector being pivotally received by the second receiver.

11. The ringed binder according to claim 10, wherein the first receiver is connected to the second cover section and the second receiver is connected to the second platform.

12. A ringed binder, comprising:

a center support section having a first platform support, a second platform support, and a center support interconnecting the first and second platform supports;

a ring assembly secured to the center support;

a first platform connected to the first platform support and configured to move between a lowered position and a raised position, wherein the first platform includes at least one inner hinge and at least one outer hinge, the at least one inner hinge being closer to the ring assembly than the at least one outer hinge, the at least one inner hinge pivotally connecting the first platform to the first platform support and the at least one outer hinge pivoting to an upright position to provide a support when the first platform is moved to the raised position, the at least one inner hinge including a first receiver connected to the first platform support, a second receiver connected to the first platform, and a C-shaped connector having a first end pivotally connected to the first receiver and a second end pivotally connected to the second receiver; and a second platform connected to the second platform support and configured to move between a lowered position and a raised position.

13. The ringed binder according to claim 12, wherein the second platform support includes at least one inner hinge and at least one outer hinge, the at least one inner hinge pivotally connecting the second platform to the second platform support and the at least one outer hinge pivoting to an upright position to provide a support when the second platform is moved to the raised position.

14. The ringed binder according to claim 12, wherein the first and second platform supports are hingedly connected to opposing sides of the center support.

* * * * *